United States Patent [19]

Walker

[11] Patent Number: 5,071,376

[45] Date of Patent: Dec. 10, 1991

[54] APPARATUS FOR EMERGENCY ENABLEMENT OF A DISABLED BOAT PROPELLER

[76] Inventor: Lynn B. Walker, 6116 S. Rice, Houston, Tex. 77081

[21] Appl. No.: 619,089

[22] Filed: Nov. 28, 1990

[51] Int. Cl.[5] ..... B63H 1/14

[52] U.S. Cl. ..... 440/49; 416/244 B; 464/32; 440/83

[58] Field of Search ..... 440/49, 71, 74, 83; 464/30, 32; 416/62, 93 A, 140, 244 B, 2

[56] References Cited

U.S. PATENT DOCUMENTS

| | | | |
|---|---|---|---|
| 3,589,833 | 6/1971 | Lancioni | 416/93 A |
| 3,827,259 | 8/1974 | Brucker | 464/32 |
| 3,857,257 | 12/1974 | Steiner et al. | 464/32 |
| 3,876,331 | 4/1975 | Den Herder et al. | 416/93 A |
| 4,097,191 | 6/1978 | Genuardi | 416/244 B |
| 4,218,896 | 8/1980 | van der Lely | 464/32 |
| 4,317,655 | 3/1982 | Schiek | 440/49 |

*Primary Examiner*—Jesus D. Sotelo
*Assistant Examiner*—Stephen P. Avila
*Attorney, Agent, or Firm*—Bill B. Berryhill

[57] ABSTRACT

Apparatus for emergency enablement of a boat propeller. The apparatus comprises a central mounting plate having an aperture for engagement with one end of the propeller shaft to which the propeller is attached. A plurality of cantilevered members, the proximal ends of which are fixed at spaced intervals around the periphery of the central mounting plate, extend perpendicular to the mounting plate for disposal within longitudinal spaces of the boat propeller.

10 Claims, 2 Drawing Sheets

APPARATUS FOR EMERGENCY ENABLEMENT OF A DISABLED BOAT PROPELLER

BACKGROUND OF THE INVENTION

1. Field of the Invention

The present invention pertains to boat propellers. More specifically, the present invention pertains to boat propellers of the type having a tubular body from which propeller blades project and an inwardly spaced hub assembly by which the propeller is attached to a propeller shaft. Still more specifically, the present invention pertains to apparatus for temporary or emergency enablement of a boat propeller which has been disabled by shearing or otherwise separating of a portion of the hub assembly thereof so that the propeller body no longer rotates in response to rotation of the propeller shaft.

2. Description of the Prior Art

There are many boats which are powered by outboard or inboard-outboard motors. Motors of the type in which the exhaust exits through the propeller utilize a boat propeller of the type which has a tubular body, from which propeller blades project, and an inwardly spaced hub assembly for attachment to a propeller shaft. The hub assembly typically includes an outer tubular member concentrically supported within the tubular propeller body by a plurality of radially or spirally extending ribs between which are a plurality of longitudinal spaces. The longitudinal spaces serve as exhaust ports for the motor or engine by which the propeller shaft is driven. An inner tubular sleeve of the hub assembly provides a central bore through which the propeller shaft extends for engagement by a nut or other fastener to attach the propeller to the propeller shaft.

The hub assembly may also include an intermediate tubular sleeve of resilient material concentrically fixed between the inner and outer sleeves of the hub assembly. This resilient intermediate sleeve absorbs shock and transmits power from the propeller shaft to the propeller body. However, the intermediate sleeve is assembled and is of a material of such that upon application of abnormal torsional forces the intermediate sleeve is sheared or separated so that the propeller body no longer rotates in response to rotation of the shaft. Thus, the intermediate sleeve acts as a shock absorber and in severe cases shears or separates from the inner and/or outer sleeves to prevent further damage to the engine, propeller shaft or other components of the boat.

Typically, abnormal shock or torsional forces are transmitted to a propeller upon contact with a submerged obstacle, e.g., log, stump, etc. or by fouling of the propeller with seaweed, rope, etc. In the event of such an occurrence and shearing or separation of the intermediate sleeve due thereto, the propeller may be disenabled and incapable of moving the boat through the water. Such a situation could be exasperating and dangerous. If a spare propeller is not available or if the boat cannot be towed by another boat, the boat and its occupants may lie powerless for hours or days with ominous consequences.

Most boat owners and operators do not prepare for propeller disablement, thinking, as many, that this would not happen to them. Others prepare for such an event by having a spare propeller on board the boat. However, to install a spare propeller, it is necessary to remove the disabled propeller by removing a nut attached to the threaded end of the propeller shaft and pulling the inner sleeve of the propeller hub assembly off of the propeller shaft. Removing the nut is frequently the simplest part of this procedure. Disengaging the inner sleeve of the hub assembly from the propeller shaft is frequently difficult and sometimes impossible under usual circumstances. The tight fit of these members, corrosion, difficult access, lack of proper tools, etc. are all reasons why such a remedy may fail. Obviously better and easier methods of emergency enablement of disabled boat propellers are needed and hoped for.

SUMMARY OF THE PRESENT INVENTION

In the present invention, apparatus is provided for temporary or emergency enablement of a boat propeller of the type having a tubular body from which the propeller blades project and an inwardly spaced hub assembly for attachment to a propeller shaft. The hub assembly would normally include an outer tubular sleeve to which the propeller body is attached, an inner tubular sleeve for engagement with a propeller shaft and an intermediate tubular sleeve of resilient material for absorbing shock and transmitting rotational forces from the propeller shaft to the propeller body. The intermediate sleeve would be shearable or separateable upon application of abnormal torsional forces thereto so that the propeller body no longer rotates in response to rotation of the shaft.

The emergency enabling apparatus may include a plate member having an aperture for engagement with and attachment to the end of the propeller shaft and a plurality of cantilevered members, the proximal ends of which are radially spaced from the plate member aperture. When the apparatus is attached to the end of the propeller shaft, the cantilevered members extend, parallel to the propeller shaft and the axis of the plate member aperture, projecting through longitudinal spaces between the propeller body and the hub assembly for engagement with ribs connecting these last two members to at least temporarily restore rotational response of the propeller body to rotation of the propeller shaft.

The emergency enabling apparatus may be installed by removing the propeller shaft nut, engaging of the plate member aperture with the end of the propeller shaft and reattachment of the propeller shaft nut. This procedure is quite easy, can be performed without removing the disabled propeller and usually within a few minutes the propeller can be enabled sufficiently so that the boat can proceed, under its own power, albeit at reduced r.p.m., to a destination where permanent repairs can be made. Many objects and advantages of the invention will be apparent from reading the description which follows in conjunction with the accompanying drawings.

DESCRIPTION OF A PREFERRED EMBODIMENT

Figure 1:
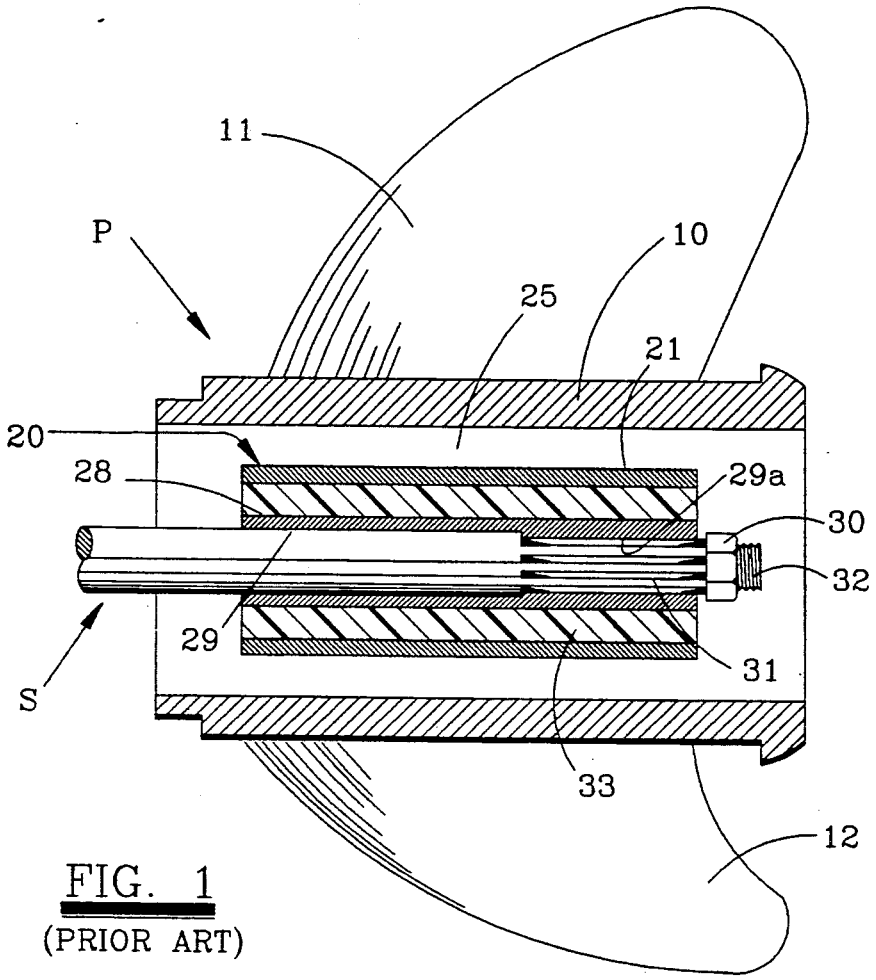
FIG. 1 (PRIOR ART)
FIG. 1 is a longitudinal drawing of a propeller, partially in section, taken along line 1—1 of FIG. 2, connected to the end of a propeller shaft.
Figure 2:
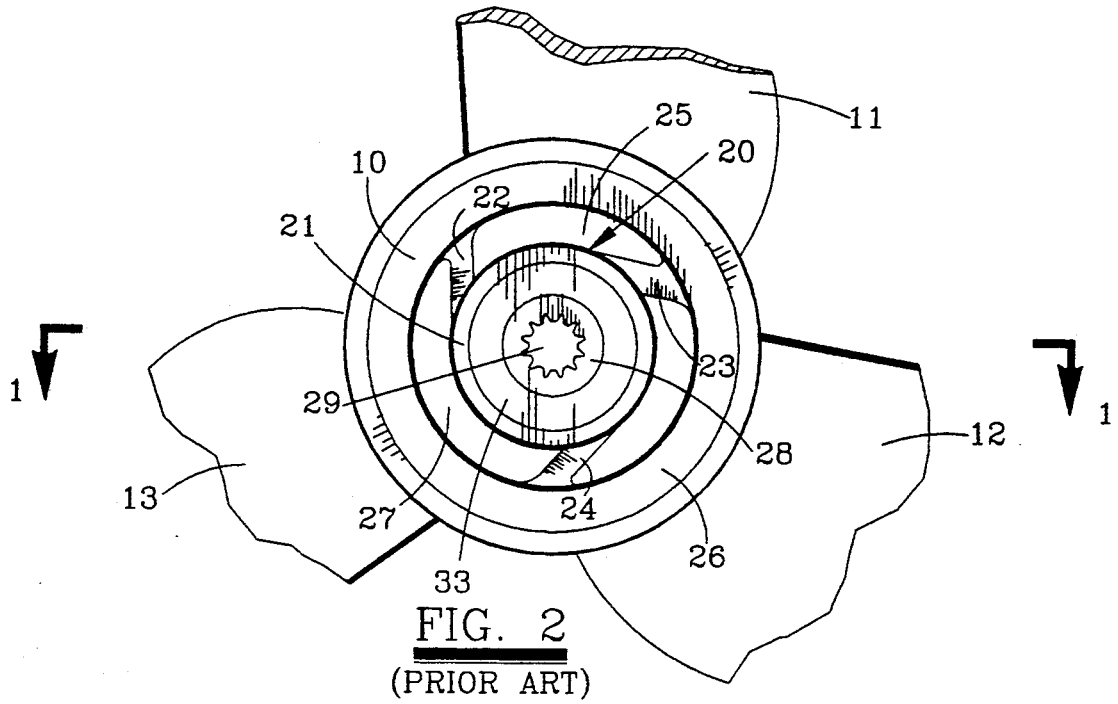
FIG. 2 (PRIOR ART)
FIG. 2 is a partial end view of the propeller of FIG. 1.

Referring first to FIGS. 1 and 2, there is shown a boat propeller P attached to the end of a propeller shaft S. The boat propeller P has a tubular body 10 from which propeller blades 11, 12, 13 project and an inwardly spaced hub assembly 20 for attachment to the propeller shaft S.

The hub assembly 20 comprises an outer tubular member 21 concentrically supported within the tubular body 10 by plurality of radially or spirally extending support members or ribs 22, 23, 24, between which are left a plurality of longitudinally elongated spaces or passages 25, 26 and 27. The purpose of the spaces 25, 26 and 27 is to provide a path for the exhaust of the engine or motor which drives the propeller shaft S. While the outer tubular sleeve 21 is described as part of the hub assembly 20, it and the ribs 22, 23, 24 by which it is supported within the tubular body 10 may actually be integrally formed therewith by molding or other means of fabrication. These components may be of aluminum, other metals or other suitable materials.

The hub assembly 20 also includes an inner tubular sleeve 28 which has a central bore 29 though which the shaft S extends for engagement by a nut 30 or other fasteners. Typically, the end of the shaft S is splined as at 31 and threaded as at 32 to receive the nut 30. The inner sleeve 28 may also be counterbored and provided with splines 29*a* to match the splines 31 of the propeller shaft S. It should be noted that in FIG. 2, the shaft S has been removed to more fully understand the components of the propeller P.

Interposed between the outer tubular sleeve 21 and the inner tubular sleeve 28 of the hub assembly 20 is an intermediate tubular sleeve 33 of a resilient material such as rubber. The intermediate sleeve 33 is tightly pressed between the outer and inner sleeves 21 and 28 and is actually bonded thereto by adhesives or any other suitable means. Thus, rotation of the propeller shaft S and the inner sleeve 28 of the hub assembly 20 is transmitted through intermediate sleeve 33 to outer sleeve 21 and the propeller body 10. Since the intermediate sleeve 33 is of a resilient material, it absorbs shock which might otherwise be absorbed by the propeller shaft S and its motor upon contact of the propeller blades 11, 12. 13 with underwater obstacles. In addition, upon the application of abnormal torsional forces to the propeller P, from contact with underwater obstacles or fouling of the propeller, the intermediate sleeve 33 and its bond with one or both of the outer and inner sleeve members 21, 28, may be sheared or separated, allowing the propeller shaft S to continue to rotate even though the propeller body 10 and its blades 11, 12 and 13 may be prevented from rotation by the underwater obstacle. This prevents greater damage to the propeller shaft S and the motor by which it is driven. Of course, after shearing or separation of the intermediate sleeve 33, the propeller body 10 and propellers 11, 12 and 13 no longer respond to rotation of the propeller shaft S. The propeller P can then be said to be disabled, requiring repair, replacement or emergency enablement.

Figure 3:
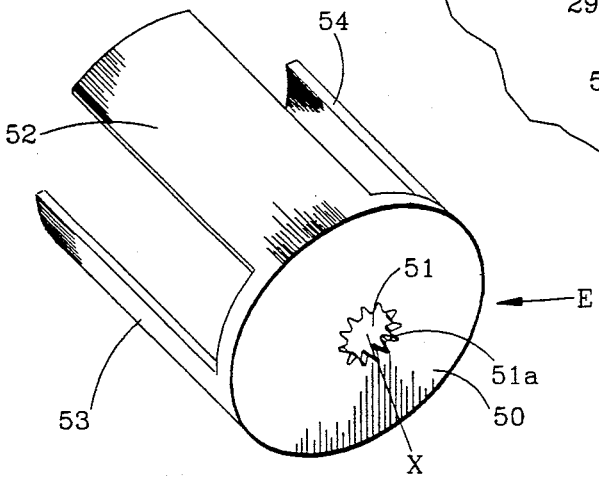
FIG. 3 is a perspective view of apparatus suitable for emergency enablement of a disabled propeller of the type shown in FIGS. 1 and 2, according to a preferred embodiment of the invention.
Figure 4:
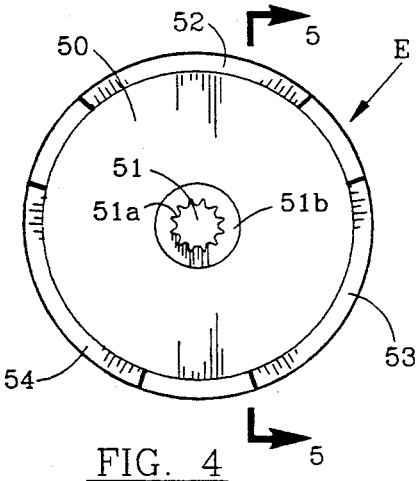
FIG. 4 is an end view of the emergency enablement apparatus of FIG. 3.
Figure 5:
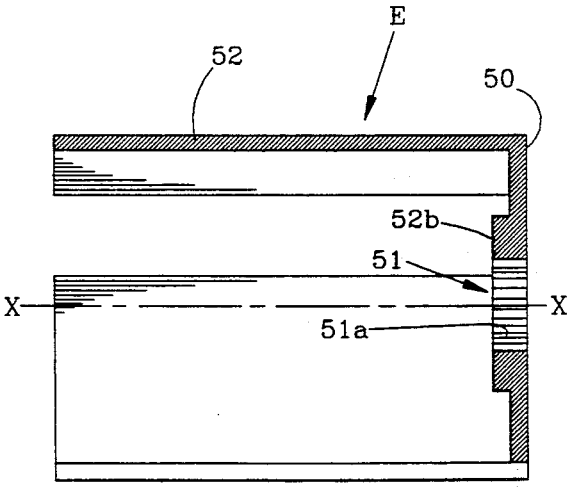
FIG. 5 is a longitudinal view, in section along line 5—5 of FIG. 4, of the emergency enablement apparatus of FIGS. 3 and 4.

Referring now to FIGS. 3, 4 and 5, there is shown emergency enabling apparatus E, according to a preferred embodiment of the invention, by which a disabled propeller of the type shown in FIGS. 1 and 2 may be at least temporarily enabled. The apparatus comprises a plate member 50, circular in the exemplary embodiment, through the center of which is an aperture 51. Aperture 51 is sized for engagement with the end of the propeller shaft S of FIG. 1. The aperture 51 may be grooved or splined as at 51*a* for positive engagement with the splines 31 of the propeller shaft S. It may also be reinforced by an annular shoulder 51*b*.

A plurality of cantilevered members 52, 53, 54, the proximal ends of which are radially spaced from the plate central aperture 51, extend parallel to the central axis X—X of the aperture 51. In the embodiment shown, the cantilevered members 52, 53, 54 are curved partially defining a cylinder one end of which is defined by circular plate 50.

Figure 6:
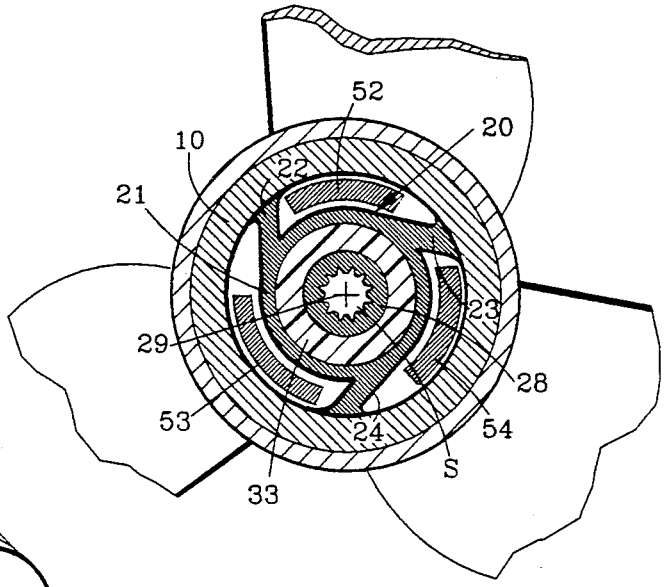
FIG. 6 is a partial cross-sectional view of the propeller of FIGS. 1 and 2 with the emergency enablement apparatus of FIGS. 3-5 attached thereto.

Upon disablement of a propeller, such as the propeller P in FIGS. 1 and 2, due to the shearing or separation of the hub assemblies intermediate sleeve 33, the nut 30 can be removed from the propeller shaft S and the distal ends of the cantilevered members 52, 53 and 54 may be inserted through the longitudinal spaces 25, 26 and 27 of the propeller P (see FIG. 6), so that the aperture 51 may be engaged with the end of the propeller shaft S. Then the nut 30 can be reengaged with the threaded portion 32 of the propeller shaft S, fixing the enabling apparatus E in place so that rotation of the shaft S will cause the cantilevered members 52, 53 and 54 to engage ribs 22, 23 and 24 at least temporarily restoring rotational response of the propeller body 10 and the propeller blades 11, 12 and 13 to rotation of the propeller shaft S. With the enabling apparatus E in place, the boat may be propelled through the water by the propeller P to a point where the enabling apparatus E and the damaged propeller P may be easily removed for repair or replacement.

A single embodiment of the invention has been described herein. However, many variations thereof can be made without departing from the spirit of the invention. Accordingly, it is intended that the scope of the invention be limited only by the claims which follow.

I claim:

1. Apparatus for emergency or temporary enablement of a disabled boat propeller having a tubular body from which propeller blades project and inwardly spaced hub means for attachment to a propeller shaft, said hub means being concentrically supported within said tubular body by a plurality of radially or spirally emanating support members between which are a plurality of elongated passages, said hub means including a tubular sleeve of resilient material for absorbing shock and transmitting power from said propeller shaft to said propeller body and blades but being shearable or separateable upon application of abnormal torsional forces thereto so that said propeller body will no longer rotate in response to rotation of said shaft; said emergency enabling apparatus comprising:

a central mounting plate having an aperture at the center thereof for engagement with one end of said propeller shaft and a plurality of cantilevered members the proximal ends of which are fixed at spaced intervals around the periphery of said central mounting plate, said cantilevered members extending, perpendicular to said central mounting plate for disposal within said elongated passages between said support members upon fixed engagement of said mounting plate aperture with said end of said propeller shaft to restore rotational response of said propeller body to rotation of said propeller shaft after shearing or separation of said tubular sleeve of said resilient material.

2. Emergency propeller enabling apparatus as set forth in claim 1 in which said mounting plate is circular and reinforced around said aperture by an annular shoulder.

3. Emergency propeller enabling apparatus as set forth in claim 2 in which said aperture is grooved to provide a surface for increased frictional engagement with said one end of said propeller shaft.

4. Emergency propeller enabling apparatus as set forth in claim 1 in which said boat propeller is held on said shaft by threaded engagement of a nut with said one end of said shaft, said nut being removable to allow engagement of said mounting plate aperture therewith, after which said nut may be reengaged with said shaft to fix said enabling apparatus to said propeller shaft.

5. Emergency propeller enabling apparatus as set forth in claim 1 in which said cantilevered members partially define a cylinder, longitudinal strips of which have been removed therebetween.

6. Apparatus for emergency enablement of a disabled boat propeller having a tubular body from which propeller blades project and an inwardly spaced hub assembly for attachment to a propeller shaft; said hub assembly comprising an outer tubular member concentrically supported within said tubular body by a plurality of radially or spirally extending ribs between which are a plurality of longitudinal passages, an inner tubular sleeve having a central bore through which said shaft extends for engagement by a fastener and an intermediate tubular sleeve of resilient material concentrically fixed between said inner and outer sleeves for absorbing shock and transmitting power from said propeller shaft to said propeller body and blades, said intermediate sleeve being shearable or separateable upon application of abnormal torsional forces thereto so that said propeller body will no longer rotate in response to rotation of said shaft; said emergency enabling apparatus comprising:

a plate member through the center of which is an aperture engageable with the end of said propeller shaft and a plurality of cantilevered members, the proximal ends of which are radially spaced from said plate member aperture, extending parallel to the central axis of said aperture so that upon fixed attachment of said apparatus to said propeller shaft the distal ends of said cantilevered members may be inserted through said longitudinal spaces for engagement with said ribs to at least temporarily restore rotational response of said propeller body to rotation of said propeller shaft in the event of shearing or separation of said intermediate sleeve.

7. Emergency propeller enabling apparatus as set forth in claim 6 in which said plate member is circular, said cantilevered members being uniformly spaced and lying in a cylinder, one end of which is defined by said circular plate.

8. Emergency propeller enabling apparatus as set forth in claim 6 in which said plate member aperture is splined or grooved for increased frictional engagement with said end of said propeller shaft.

9. Emergency propeller apparatus as set forth in claim 6 in which said plate member aperture may be placed on said end of said propeller shaft adjacent one end of said inner sleeve member, upon removal of said fastener, after which said fastener may be replaced for said fixed attachment of said apparatus to said propeller shaft.

10. Emergency propeller apparatus as set forth in claim 9 in which said plate member is thicker around said aperture providing reinforcement for bearing against said one end of said inner sleeve member.

* * * * *